United States Patent [19]

Hofer

[11] 4,342,479

[45] Aug. 3, 1982

[54] HANGING IMPLEMENT FOR GARMENT BAGS

[76] Inventor: Wolfgang Hofer, 11 Soder Rd., North Caldwell, N.J. 07006

[21] Appl. No.: 217,212

[22] Filed: Dec. 17, 1980

[51] Int. Cl.[3] ..... A45C 13/26

[52] U.S. Cl. ..... 294/142; 190/57; 206/279; 206/284; 294/159

[58] Field of Search ..... 294/26, 27 H, 137, 142, 294/143, 145, 146, 153, 158, 159, 167; 16/110 R; 74/551.9; 105/354; 190/41 R, 41 B, 57, 58 R, 58 A, 58 B, 58 C; 206/278, 279, 281, 284–289

[56] References Cited

U.S. PATENT DOCUMENTS

| | | | |
|---|---|---|---|
| 2,629,529 | 2/1953 | Threeton | 294/143 |
| 2,689,631 | 9/1954 | Marks | 190/58 R X |
| 2,769,587 | 11/1956 | Threeton | 294/142 |
| 3,744,600 | 7/1973 | Belland et al. | 294/142 X |
| 3,999,656 | 12/1976 | Hydorn | 206/284 X |
| 4,091,976 | 5/1978 | Morse | 294/142 |
| 4,299,342 | 11/1981 | Kessler | 294/137 X |

*Primary Examiner*—Johnny D. Cherry
*Attorney, Agent, or Firm*—Samuelson & Jacob

[57] ABSTRACT

A hanging implement is attached to a garment bag for facilitating handling the garmet bag during hanging the garment bag upon a support and removal of the garment bag from the support, the hanging implement having a handle with a handgrip portion and a flange portion, the flange portion including a stop shoulder for providing an abutment for a hand when the hand is placed upon the handgrip portion for lifting the garment bag during hanging and removal, the flange portion further providing a display surface for displaying information capable of being viewed readily when the garment bag is hung upon the support.

14 Claims, 11 Drawing Figures

HANGING IMPLEMENT FOR GARMENT BAGS

The present invention relates generally to facilitating the identification and handling of luggage and pertains, more specifically, to an implement for hanging a garment bag.

Garment bags find use as convenient means for carrying hanging garments, such as a suit or a dress, and have become especially popular as "carry-on" luggage in air travel. Airliners very often are provided with racks especially designated for hanging garment bags so that the garment bags can be carried on board by passengers and will be stored in such a way as to minimize wrinkling of the garments contained within the garment bags.

The increasing use of garment bags as carry-on luggage has created an increased demand for quick identification of an individual passenger's garment bag and ease of manipulating the garment bag as it is hung upon or removed from a support provided by the designated luggage racks.

It is an object of the present invention to provide an ergonomically sound implement which facilitates the identification and handling of a garment bag when the bag is hung upon or removed from a support.

Another object of the invention is to make it more convenient to hang a garment bag in a designated compartment and to ease the pick-up of the garment bag from the compartment.

Still another object of the invention is to decrease the boarding and deboarding times of passengers traveling with garment bags.

Yet another object of the invention is to provide means by which a garment bag is quickly and easily identified for ease of location by either a passenger or a cabin crew member.

A further object of the invention is to provide an implement which may be supplied readily either as an integral component of a new garment bag or as a replacement item for an existing garment bag.

A still further object of the invention is to provide a hanging implement for a garment bag, which implement eliminates the need for additional identification on the garment bag.

Yet a further object of the invention is to provide a hanging implement for a garment bag, the implement having a handle of appropriate dimensions, configuration and orientation, as well as being located advantageously, for easing the handling of the garment bag.

Another object of the invention is to provide a hanging implement for a garment bag, the implement including a handle with a handgrip of adequate size and mounted for swinging and swiveling movements so as to enable a firm grip under varying conditions.

A further object of the invention is to provide a hanging implement of the type described and which is capable of being manufactured in several styles and colors so as to match the garment bag to which it is attached.

Still another object of the invention is to provide a hanging implement of the type described and which includes a handgrip portion capable of manufacture in several sizes so as to match a user's grip for better comfort and effectiveness.

A still further object of the invention is to provide a hanging implement of the type described and which may be manufactured economically in large numbers of uniform high quality so as to minimize cost while increasing the utility of garment bags.

The above objects, as well as still further objects and advantages, are attained by the present invention which may be described briefly as a hanging implement for a garment bag of the type which is adapted be hung from one end thereof upon a support, the one end ordinarily being provided with means for attaching thereto a hanging device, the hanging implement comprising: hook-shaped means for engagement with the support; attachment means for attachment to the garment bag; a handle having opposite ends and extending longitudinally between the hook-shaped means, located at one of the opposite ends, and the attachment means located at the other of the opposite ends, the handle having a handgrip portion extending longitudinally between the hook-shaped means and the attachment means, and a flange portion between the handgrip portion and the hook-shaped means, the flange portion extending laterally beyond the handgrip portion adjacent the hook-shaped means; a stop shoulder extending generally laterally along the flange portion and confronting the handgrip portion for providing an abutment for a hand when the hand is placed upon the handgrip portion for lifting the garment bag in a longitudinal direction; and a display surface extending generally longitudinally along the flange portion for displaying information capable of being viewed in general lateral directions when the garment bag is hung upon the support.

The invention will be understood more fully, while still further objects and advantages thereof will become apparent, in the following detailed description of embodiments of the invention illustrated in the accompanying drawing, in which.

Figure 1:
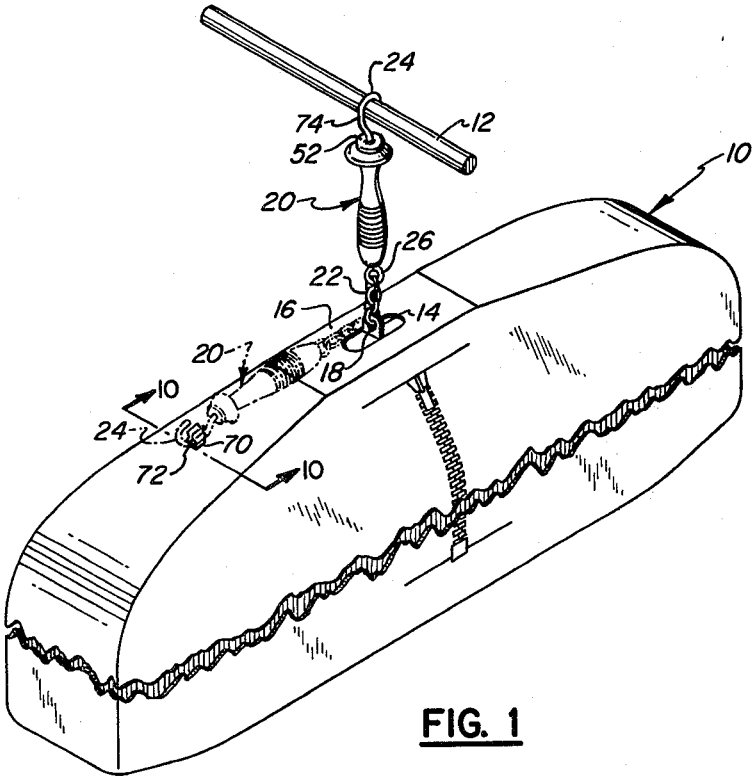
FIG. 1 is a pictorial perspective view illustrating a hanging implement constructed in accordance with the invention and in use hanging a garment bag from a support.

Referring now to the drawing, and especially to FIG. 1 thereof, a typical garment bag is shown at 10 and is seen suspended from a support 12. Garment bag 10 is a piece of luggage designed to hold one or more suits or dresses in such a way that the garments are hung vertically when the garment bag is hung from a suitable support, such as support 12. The design and construction of garment bags is well known and garment bag 10 may be constructed in any one of a number of known configurations.

One feature of the typical garment bag is the provision of means for attaching a hanging device, such as a hook, to enable the garment bag to be hung vertically. Thus, garment bag 10 includes a tab 14 which projects upwardly from the top 16 of the garment bag 10. Tab 14 has an aperture 18 therein for receiving a device which is to be used for hanging the garment bag. In the illustration of FIG. 1, the hanging device is in the form of hanging implement 20 which is affixed to tab 14 by means of a relatively short chain 22. Hanging implement 20 is constructed in accordance with the present invention and includes hook-shaped means in the form of hook 24 and attachment means in the form of eye 26 which is connected to chain 22. An elongate means interconnects the hook 24 with the eye 26 to complete the connection between hook 24 and garment bag 10, as will be described in greater detail below.

Figure 2:
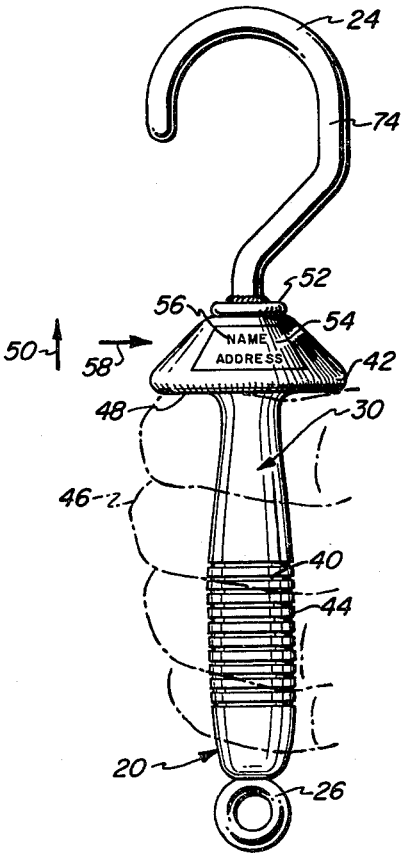
FIG. 2 is an enlarged elevational view of the hanging implement.
Figure 3:
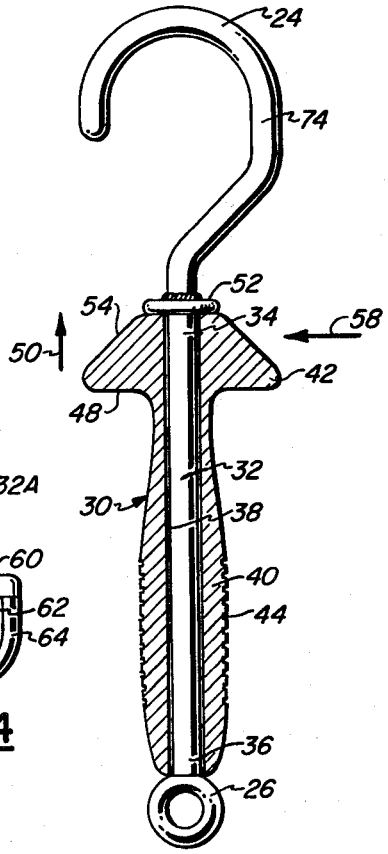
FIG. 3 is a longitudinal cross-sectional view of the hanging implement.
Figure 5:
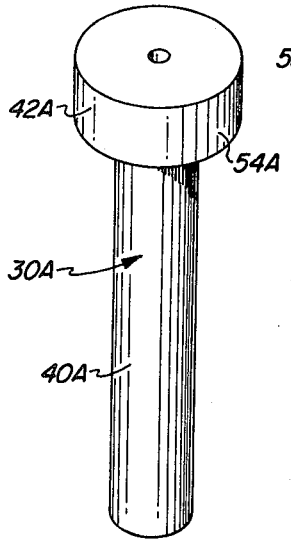
FIGS. 5 through 9 are isometric views of alternate handle configurations for the hanging implement.
Figure 6:
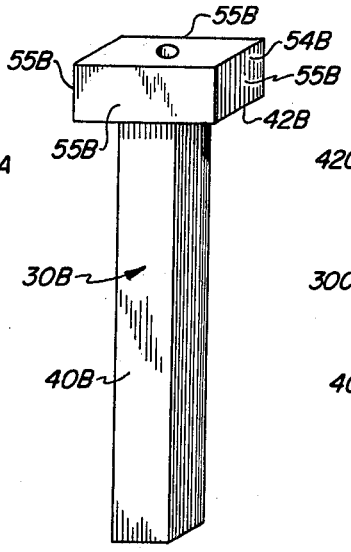
Figure 7:
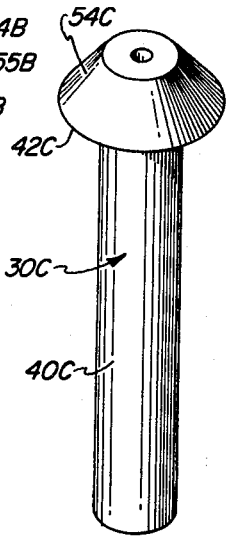
Figure 8:
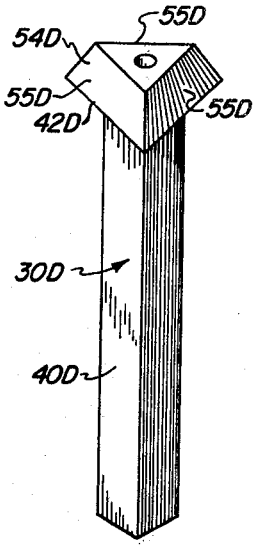
Figure 9:
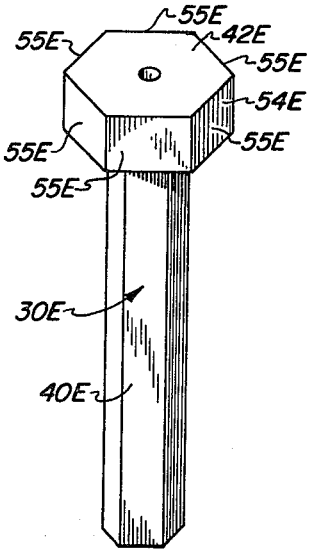

Turning now to FIGS. 2 and 3, as well as to FIG. 1, hanging implement 20 includes a handle 30 which is provided in order to facilitate handling of the garment bag 10 when the garment bag 10 is to be hung upon support 12 and when the garment bag 10 is to be removed from the support 12. Thus, handle 30 surrounds the elongate means, which is shown in the form of a rod 32 interconnecting hook 24 with eye 26, and extends longitudinally between an upper end 34 and a lower end 36. A longitudinal bore 38 in handle 30 accommodates rod 32 and preferably has a diameter sufficiently larger than that of rod 32 so that the handle 30 can swivel on the rod 32. Handle 30 is provided with a handgrip portion 40 and a flange portion 42. The handgrip portion 40 has an external configuration 44 which is contoured for ease of grip so that the person handling garment bag 10 may place his or her hand comfortably around the handgrip portion 30, as shown in phantom at 46 in FIG. 2. The flange portion 42 provides a stop shoulder 48 which extends laterally along the flange portion 42 and confronts the handgrip portion 40 to establish an abutment for the hand 46 for facilitating the lifting of the garment bag 10 in the longitudinally upward direction indicated by arrow 50. A retainer in the form of collar 52 is affixed to rod 32 and serves to preclude upward movement of handle 30 relative to rod 32 beyond the position where handle 30 contacts collar 52 so that further upward movement of handle 30 will be transmitted to rod 32 and consequently to hook 24 and eye 26. Thus, handle 30 will not move upwardly to a position over hook 24 where the operation of hook 24 could be impeded by the handle and garment bag 10 is lifted easily for placement of the hook 24 over support 12 or for removal of the hook 24 from support 12. Where support 12 is a part of a rack (not shown) provided in the cabin of an airliner, for example, a passenger or a cabin crew member readily may hang the garment bag 10 on the support 12 upon boarding. Likewise, removal of the garment bag 10 from the rack is facilitated for expediting deboarding when the passenger reaches his or her destination.

In order to expedite further the deboarding procedure, flange portion 42 is provided with a display surface 54 which extends generally longitudinally along the flange portion 42. Display surface 54 provides means along which information 56 can be displayed for view in generally lateral directions, as indicated by arrow 58. Information 56 usually will pertain to the name, address, telephone number or any other data which serves to identify the owner of the garment bag 10. Thus, the passenger or crew member readily can identify the correct garment bag 10 when it is desired to retrieve the garment bag 10 and deboarding is accomplished more quickly.

Identification of a specific garment bag 10 can be facilitated by constructing handle 30 in different colors or in different shapes. In the illustrated embodiment of FIGS. 1 through 3, the hanging implement 20 is provided with a wooden handle 30 fitted over a steel rod 32 which is bent into a hook shape at one end to provide the hook 24 unitary with the rod 32 and into a loop shape at the other end to provide the eye 26 unitary with the rod 32. Sufficient clearance is provided between the central bore 38 and the rod 32 to enable the handle 30 to rotate on the rod 32. However, where it is desired to have handle 30 fixed against rotation relative to rod 32, such clearance need not be present. Collar 52 is affixed to the rod 32 as, for example, by welding. Alternately, hook 24 may be deformed or bent in the vicinity of collar 52 to retain the collar in place without welding. Eye 26 is interconnected with tab 14 by chain 22; however, alternate connecting devices may be employed to secure rod 32 to the garment bag 10. Any one of a variety of fasteners and connectors can be employed, depending upon the construction of the particular garment bag.

Figure 4:
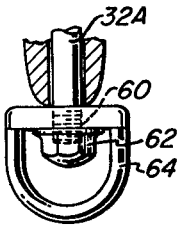
FIG. 4 is a fragmentary elevational view illustrating an alternate construction.

In some instances, it may be desirable to affix handle 30 to rod 32 against relative rotation, in which case a separate swivel may be installed between rod 32 and the garment bag 10. As seen in FIG. 4, as an alternate for rod 32 with eye 26, a rod 32A may be provided which is similar to rod 32 in all respects except that in place of eye 26 rod 32A is threaded at the lower end 60 and a threaded fastener 62 secures a swivel link 64 to the rod 32A. Thus, rod 32A may be affixed to a handle 30 and the desired swivel action between handle 30 and a garment bag to which the handle is attached is attained through swivel link 64, which is free to swivel relative to the rod 32A. Other attachment means may be provided as necessary to connect the hanging implement with a particular garment bag. Hanging implement 20 thus can be supplied as original equipment with garment bags or may be used as a replacement item for an existing garment bag. In other instances, hook 24 can be attached directly to the handle 30 and handle 30 can be attached directly to the garment bag.

Alternate handle shapes and colors may be provided for aesthetic reasons as well as for identification purposes. Turning now to FIGS. 5 through 9, alternate handle configurations are illustrated in the form of handles 30A, 30B, 30C, 30D and 30E. Handle 30A has a cylindrical handgrip portion 40A and a cylindrical flange portion 42A. Identification information is displayed along display surface 54A. Handle 30B includes a handgrip portion 40B having a square transverse cross-section and a rectangular flange portion 42B having a display surface 54B with several facets 55B. Handle 30C also has a cylindrical handgrip portion at 40C and includes a frusto-conical flange portion 42C with a display surface 54C. In handle 30D, handgrip portion 40D has a triangular transverse cross-section and flange portion 42D is in the form of a frustum of a pyramid, providing a display surface 54D with three facets 55D. Handle 30E has a handgrip portion 40E with a hexagonal transverse cross-section and a hexagonal flange portion 42E with a display surface 54E having six facets 55E. It will be apparent that a wide variety of handle shapes is available. Likewise, the handgrips can be fabricated in different dimensions to fit hands of different sizes. The handles preferably are constructed of wood, but may be fabricated from other materials, such as molded synthetic resins, leather, cork and other materials known to those skilled in the art of handles.

Figure 10:
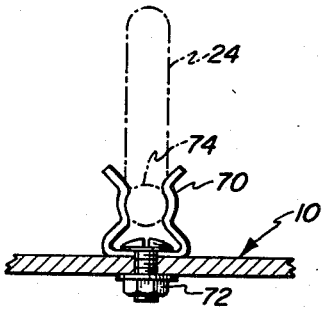
FIG. 10 is an enlarged cross-sectional view taken along line 10—10 of FIG. 1.

Turning now to FIG. 10, as well as to FIG. 1, where it is desirable to provide for the stowing of hanging implement 20, garment bag 10 may be provided with a retaining device, such as that shown in the form of spring clip 70. Spring clip 70 is affixed to the garment bag 10 by fastener means, illustrated in the form of a nut and bolt assembly 72. Hanging implement 20 may be stowed at will merely by inserting a retaining portion 74 (also see FIGS. 2 and 3) of hook 24 into spring clip 70 to secure the hanging implement 20 against the garment bag 10, as illustrated in phantom in FIG. 1.

Figure 11:
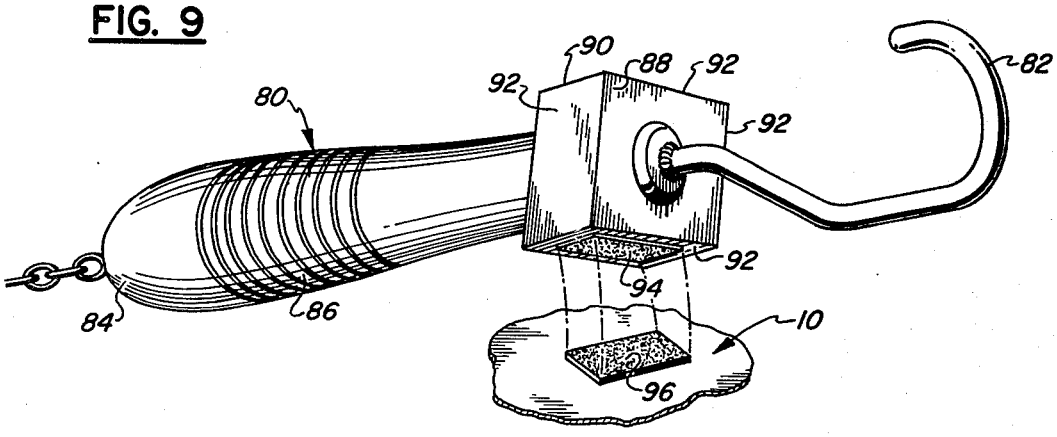
FIG. 11 is a perspective view showing an alternate hanging implement and a securing arrangement therefor.

Alternate retaining means for securing a hanging implement to a garment bag for stowage is illustrated in FIG. 11 in which there is shown a hanging implement 80 having a hook 82 and a handle 84 with a handgrip portion 86 and a flange portion 88. Flange portion 88 has a generally rectangular configuration providing a display surface 90 with four facets 92. In this instance, however, one of the facets 92 carries one element 94 of a hook-and-loop type fastener, known as VELCRO, affixed thereto, while the garment bag 10 itself carries the complementary element 96 of the fastener. In order to stow the hanging implement 80, the implement is placed into a stowed position where element 94 is pressed against complementary element 96 to effect the necessary securement. The nature of the hook-and-loop type fastener enables selective disconnection when desired for placement of the hanging implement in hanging position.

The above-described hanging implement clearly facilitates the handling of a garment bag by providing a handle which can be gripped firmly while the garment bag is lifted to hook the garment bag to a support, or to unhook the garment bag from a support. The handle provides ergonomically sound means for accomplishing what otherwise has been shown to be an awkward task and is adapted for use as original equipment with garment bags or as a replacement item for existing garment bags. Further, the hanging implement provides instantaneous identification, as well as aesthetic appeal.

It is to be understood that the above detailed description of embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. A hanging implement for a garment bag of the type which is adapted to be hung from one end thereof upon a support, the one end ordinarily being provided with means for attaching thereto a hanging device, said hanging implement comprising:

hook-shaped means for engagement with the support;

attachment means for attachment to the garment bag;

a handle having opposite ends and extending longitudinally between the hook-shaped means, located at one of the opposite ends, and the attachment means, located at the other of the opposite ends, the handle having a handgrip portion extending longitudinally between the hook-shaped means and the attachment means, and a flange portion between the handgrip portion and the hook-shaped means, the flange portion extending laterally beyond the handgrip portion adjacent the hook-shaped means;

a stop shoulder extending generally laterally along the flange portion and confronting the handgrip portion for providing an abutment for a hand when the hand is placed upon the handgrip portion for lifting the garment bag in a longitudinal direction; and a display surface extending generally longitudinally along the flange portion for displaying information capable of being viewed in general lateral directions when the garment bag is hung upon the support.

2. The invention of claim 1 including elongate means interconnecting the hook-shaped means and the attachment means, with the handle laterally surrounding the elongate means.

3. The invention of claim 2 wherein the handle has a generally tubular construction which includes a central, longitudinal bore, and the elongate means extends into the bore with sufficient clearance to permit rotation of the handle relative to the elongate means.

4. The invention of claim 2 or 3 wherein the elongate means comprises an essentially straight rod extending longitudinally between an upper end and a lower end.

5. The invention of claim 4 wherein the hook-shaped means includes a hook integral with the rod at the upper end, and the attachment means includes an eye integral with the rod at the lower end.

6. The invention of claim 5 including a retainer affixed to the rod between the hook and the flange portion of the handle to retain the handle against movement upwardly over the hook.

7. The invention of claim 6 wherein the handgrip portion has an outer surface configuration contoured for ease of grip.

8. The invention of claim 5 wherein the rod, the hook, and the eye are unitary with one another.

9. The invention of claim 1 wherein the hook-shaped means includes a hook located at the one of the ends of the handle.

10. The invention of claim 1 or 2 wherein the attachment means includes an eye located at the other of the ends of the handle.

11. The invention of claim 1 wherein the hanging implement includes retaining means for securing the hanging implement in a stowed position upon the garment bag.

12. The invention of claim 11 wherein the retaining means includes a retaining portion of the hook-shaped means and a retaining device complementary to said retaining portion for attachment to the garment bag.

13. The invention of claim 11 wherein the retaining means includes a first element of a selectively disconnectable fastener affixed to the handle, and a second element of said fastener for attachment to the garment bag.

14. The invention of claim 13 wherein the fastener is a hook-and-loop type fastener.

* * * * *